United States Patent [19]

Steinkamp

[11] Patent Number: 4,991,649

[45] Date of Patent: Feb. 12, 1991

[54] OIL WELL PACKER RETRIEVER

[76] Inventor: Manfred Steinkamp, 148 Market Street, Aberdeen, Great Britain, AB1 2PP

[21] Appl. No.: 919,244

[22] Filed: Oct. 15, 1986

Related U.S. Application Data

[63] Continuation of Ser. No. 773,839, Sep. 6, 1985, abandoned, which is a continuation of Ser. No. 707,539, Mar. 4, 1985, which is a continuation of Ser. No. 545,399, Sep. 15, 1983, abandoned.

[30] Foreign Application Priority Data

Jan. 27, 1982 [GB] United Kingdom ..... 8202308

[51] Int. Cl.[5] ..... E21B 10/64

[52] U.S. Cl. ..... 166/55.7; 294/86.32; 294/86.34

[58] Field of Search ..... 166/55, 55.1, 55.7; 175/398, 411; 294/86.18, 86.32, 86.34

[56] References Cited

U.S. PATENT DOCUMENTS

| | | | |
|---|---|---|---|
| 2,096,525 | 10/1937 | Neilson | 294/86.32 |
| 2,904,114 | 9/1959 | Webb et al. | 294/86.18 |
| 3,019,840 | 2/1962 | Kennard | 294/86.34 |
| 3,108,637 | 10/1963 | Lee et al. | 294/86.34 |
| 3,114,416 | 12/1963 | Kammerer | 166/55.7 |
| 3,282,358 | 1/1966 | Carothers | 175/411 |
| 3,352,593 | 11/1967 | Webb | 294/86.34 |
| 4,191,255 | 3/1980 | Rives | 166/55.7 |

FOREIGN PATENT DOCUMENTS

| | | |
|---|---|---|
| 779571 | 11/1980 | U.S.S.R. . |
| 810928 | 3/1981 | U.S.S.R. . |
| 834870 | 5/1960 | United Kingdom . |
| 916579 | 1/1963 | United Kingdom . |

OTHER PUBLICATIONS

Composite Catalog published by World Oil, 1976, vol. 1.

Composite Catalog published by World Oil, 1976, vol. 2.

Baker Service Tools Catalog, 10/1981.

*Primary Examiner*—William P. Neuder

*Attorney, Agent, or Firm*—Mason, Fenwick & Lawrence

[57] ABSTRACT

An oil well packer retriever has a packer miller (6) which has a series of fin-like blades radiating from a central tube string (2). The blades are faced with tungsten carbide and in use these mill away the packer allowing it to drop by gravity. A packer catcher (7) catches and retains the fallen packer for removal from the well. The weight of the packer held by the catcher (7) bears on a shear collar (8) which is secured to the central string (2) by one or more shear bolts the combined strength of which is known. Should the shear stress on the collar (8) exceed that which has been preselected by the number and/or material of the shear bolts, the bolts shear releasing the collar (8) which drops out of engagement the catcher (7) allowing the retriever to be withdrawn from the packer. The packer retriever can under normal conditions mill out and extract several packers without redressing the blades and replacing the catcher.

7 Claims, 4 Drawing Sheets

OIL WELL PACKER RETRIEVER

This application is a continuation of application Ser. No. 773,839, filed Sept. 6, 1985, now abandoned, which is a continuation of application Ser. No. 707,539, filed Mar. 4, 1985, which is a continuation of Ser. No. 545,399, filed Sept. 15, 1983, now abandoned.

This invention relates to an oil well packer retriever comprising an elongate central core, a packer miller arranged on the core for milling the packer to release same from the well casing, and spaced from the packer miller along the core a packer catcher for engaging the released packer enabling removal from the well.

Production oil wells are fitted with a packer which is a solid metal cylindrical body which is secured to the well casing against upward and downward movement by circumferential upward- and downward-facing barbs. The packer has a central bore through which liquid can pass, the bore having an upper cylindrical portion and a lower cylindrical portion of greater diameter with a taper therebetween.

The packer is sealed to the casing by resilient sealing rings. Packers of the type described are of a widely standardised design throughout the oil production industry.

Should the well packer require replacement, for example, if the seals should break permitting escape of gas, a milling tool is fed down the well to mill and thus destroy the packer retainers and a retrieving tool is used to fish the remaining parts of the packer from the well.

Combined milling and retrieving tools are known. One such known tool has a central probe carrying a packer catcher which penetrates the central bore of the packer and locates in the large diameter lower portion thereof. A cylindrical mill with a tungsten carbide cutting face located on the lower cylinder rim mills away the packer barbs in order to free the packer from the well casing and permits its withdrawal from the well. Particulate metal millings flow through the cylinder and up the well into debris collectors.

With a cylindrical mill it is often necessary to remove the packer retriever and replace the tungsten carbide cutting face and re-apply the packer retriever several times before the packer is freed. Because of this it is necessary that the packer catcher can be repeatedly engaged with an disengaged from the packer.

The prior art approached the problem of packer removal from the point of view of being able repeatedly to engage the catcher with the packer and disengage the catcher from the packer while retaining the cylindrical mill. The present invention approaches the same problem from a different point of view in that the cylindrical mill is replaced by a miller with one or more radial "fin"-like blades, which cut rather than grind and which can carry a deep dressing of tungsten carbide. In the vast majority of cases such a miller has been found to be able to mill out the packer in a single operation sufficiently to free the packer for removal. Because of this, there is no need for the catcher to be able repeatedly to engage with and disengage from the packer. In order, however, to be able to remove the packer retriever from the packer in an emergency a shear collar is provided.

The present invention is improved in that the packer catcher comprises a catch sleeve slidable along the core with no mutually engageable formations and slotted to form a series of resilient fingers extending in a direction away from the packer miller, and a shear collar secured on the core by one or more shear bolts or pins and releasable from the core in the event that stress on the collar exceeds a preselected value, thickened free ends of the fingers being urged by a spring in camming engagement with the collar for engaging the packer, and in that the packer miller comprises one or more radial "fin"-like blades, the or each blade having a cutting face bounded by a longitudinal edge and a leading end edge, which edges both carrying a dressing of tungsten carbide.

Preferably, the invention is also improved in that the core is hollow and includes means for delivering a jet of liquid proximate the cutting face of the or each blade.

Preferably also, the core terminates in a milling head on the side of the packer catcher remote from the packer miller and the invention is improved in that the core is hollow and includes means for delivering a jet of liquid proximate the milling head.

The invention will now be described, by way of example, with reference to the accompanying drawings of which:

Figure 1:
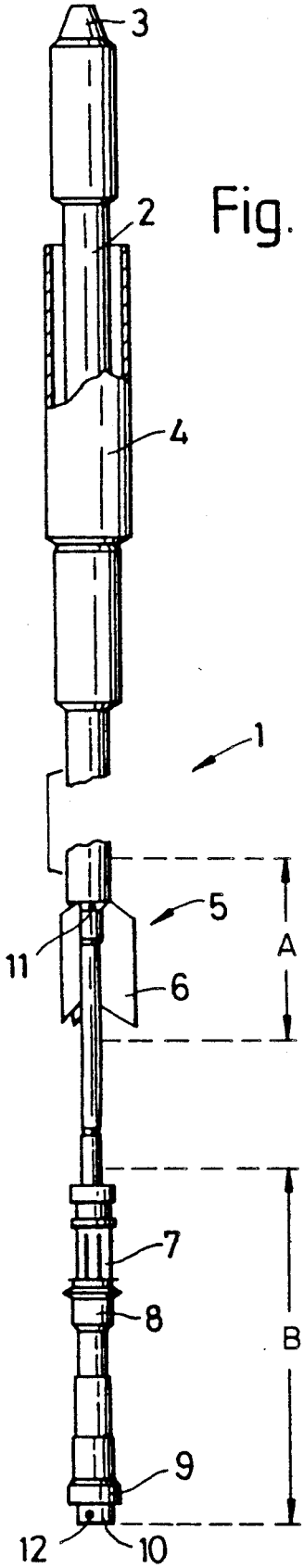
FIG. 1 is a layout sketch showing the arrangement of parts throughout the length of a packer retriever incorporating this invention.

Referring to FIG. 1 of the drawings, a packer retriever of this invention is an elongate assembly of parts, the main features of which are shown schematically to illustrate their sequential arrangement from top to bottom.

The retriever 1 has a tubular bore 2 extending from end to end for throughflow of liquid. The assembly is attachable to a drill string by standard API conical screwed connectors, for example as indicated at 3.

The assembly includes one or, preferably, more debris collectors 4(shown in part-section in FIG. 1).

A packer miller 5 has radially extending fin-like projections 6 faced on their leading faces with tungsten carbide.

A packer catcher consists of a catch sleeve 7 having a series of spring steel fingers arranged for spring-engagement in the mill-out extension bore of a packer.

A shear collar 8 is fixed by shear bolts or pins (and pin retainer screws) and is released by excessive pressure being applied to it during withdrawal of the retriever from the oil well. Once released the shear ring and catch sleeve fall into engagement with a retaining ring 9.

The assembly terminates in a milling head 10 dimensioned to pass through the bore of a packer to remove any debris therein.

Liquid is pumped through the assembly during use to exit therefrom via ports located at 11 and 12 as debris-removing jets.

Figure 2:
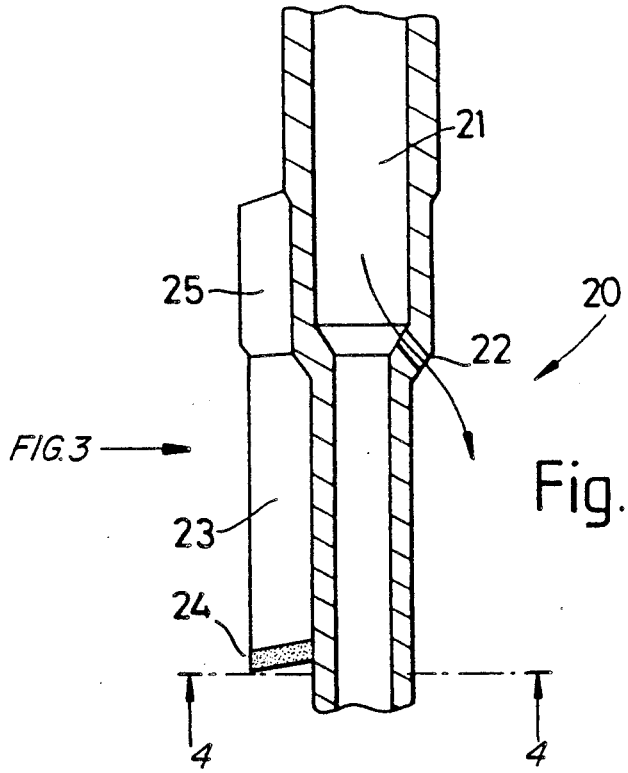
FIG. 2 is a longitudinal section of the length indicated by "A" in FIG. 1.
Figure 3:
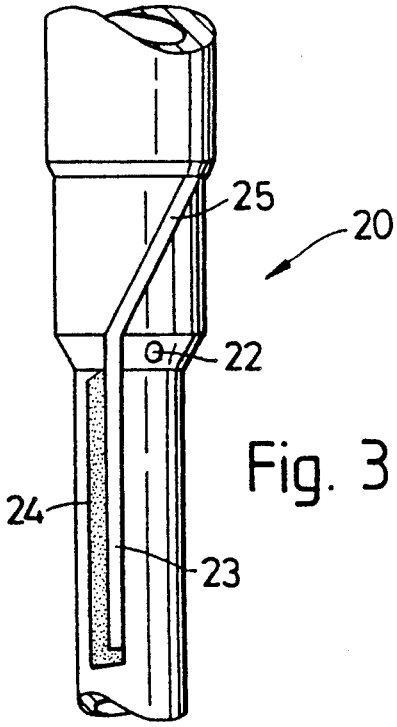
FIG. 3 is an elevation from the direction indicated by arrow C in FIG. 2.
Figure 4:
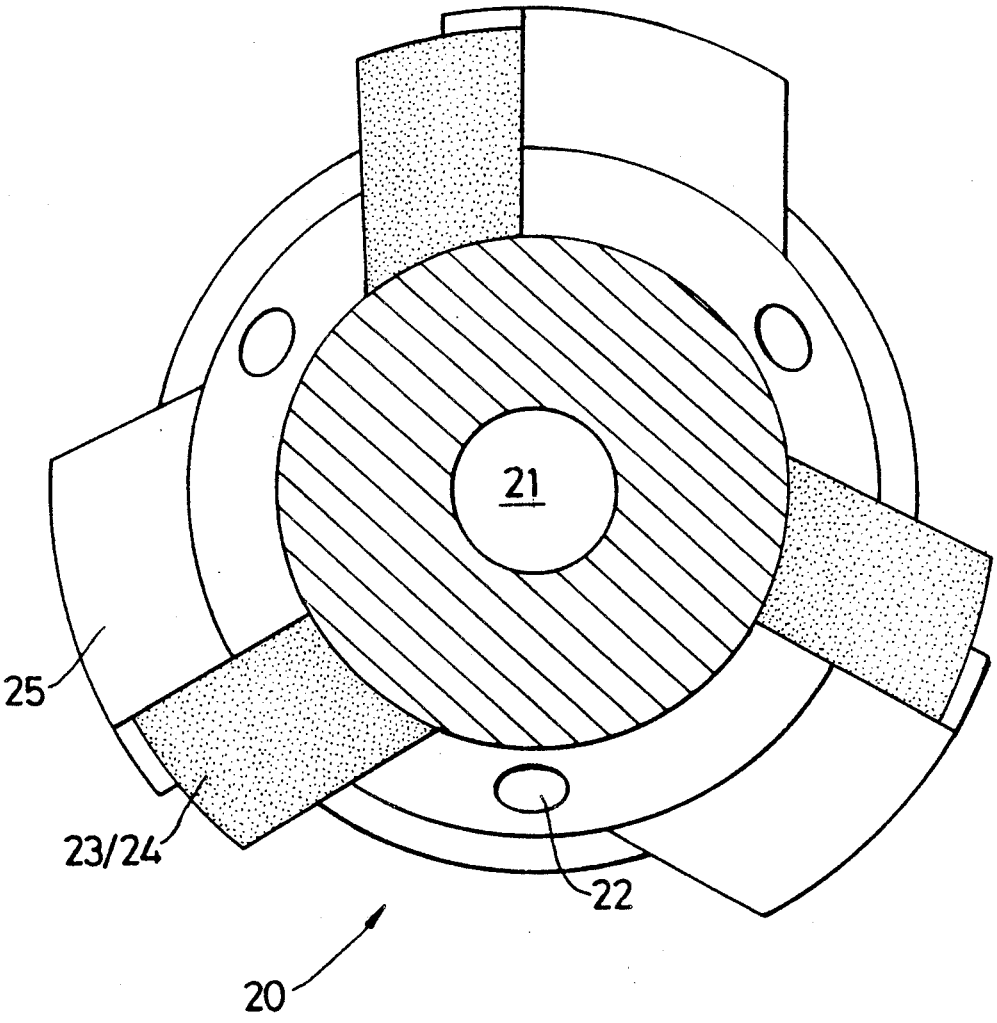
FIG. 4 is a section taken on line D—D in FIG. 3.
Figure 5:
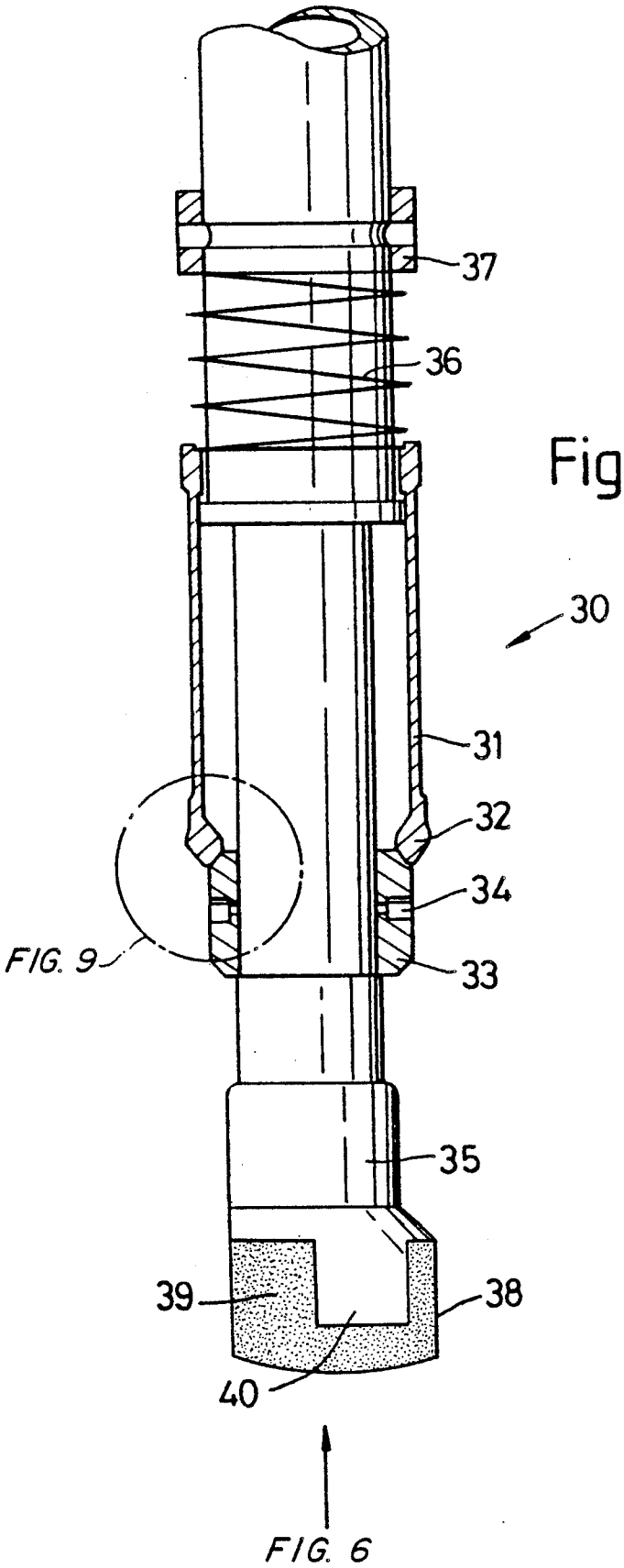
FIG. 5 is a longitudinal part-section of the length indicated by "B" in FIG. 1.

Referring to FIGS. 2, 3 and 4, a packer miller 20 has an internal bore 21 with an exit port 22 for outflow as a jet of liquid pumped through the bore 21. The miller 20 carries a number, normally three, of radially directed fin-like blades 23 (only one is shown in FIGS. 2 and 3, for clarity) the longitudinal edges of the faces and lower edges of which carry a dressing 24 of tungsten carbide as shown. Each blade 23 has a radially enlarged upper extension 25 angled to the blade as shown in FIG. 3. The diameter of the circle of rotation of blade extension 25 is approximately equal to that of the oil well in which the packer retriever is to be used, the purpose being to assist centering of the retriever and more particularly to prevent damage to the well casing by the blades 23. An alternative arrangement which is not illustrated and which is convenient for larger diameter wells is to provide further up the string a non-rotating ribbed rubber sleeve which has approximately the same diameter of the well.

Referring now to FIGS. 5 to 8, a packer catcher 30 has a catch sleeve 31 which is of cylindrical form with a series of axial slots cut along part of its length forming a series of fingers. To impart more flexibility to the fingers and to provide a degree of stress relief a bore is provided extending from the head of each axial slot into the metal of the catcher.

The lower edge 32 of the sleeve 31 is of arrowhead shape in cross-section. This edge 32 bears on the upper rim of a shear collar 33 which is fixed to the central tube of the retriever by one or more shear bolts or pins inserted in apertures 34 in the collar. At a lower level, a retaining collar 35 is provided to prevent loss of the shear collar 33 should it be released during use. The upper end of the catcher 30 is slidable on a plain uninterrupted cylindrical surface of the central tube of the assembly and engages a helical compression spring 36 held against a spring retainer 37 which is fixed to the central tube of the assembly.

Figure 6:
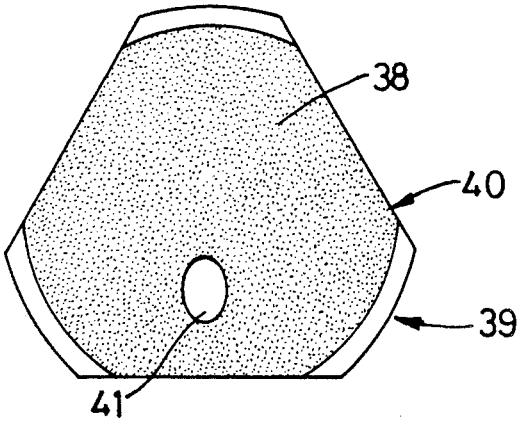
FIG. 6 is an end view from the direction indicated by arrow E in FIG. 5.

The lowest end of the retriever carries a milling head 38 which has the cross sectional shape shown in FIG. 6, having curved faces 39 and flat faces 40. The milling head 38 is dressed with tungsten carbide on the curved faces 39 and on its underside but the flat faces 40 are not so dressed. A liquid exit port 41 communicates with the internal bore of the retriever assembly for outflow of a jet of liquid therefrom.

The manner of operation of the packer retriever will now be described. The retriever is screwed to a drill string and lowered into the oil well from which a packer has to be removed. The milling head 38 enters the bore of the packer which frequently contains debris. The retriever is then rotated and liquid is pumped through its internal bore. A jet of this liquid exits from port 41 in the milling head and flushes the debris up the well where it is caught in debris collectors 4 or carried to surface. The shape of the milling head 38 is such that it self-centres in the bore of the packer and the wide spaces between the flat faces 40 and the bore of the packer permit a fast free-flow jet of liquid to flush away large and small pieces of debris and swarf.

As the milling head 38 proceeds further through the packer, (and any string of pipes below) the packer catcher 31 retractable against the spring 36, passes progressively through the packer and into the mill-out extension of the packer where the spring 31 again pushes the edge 32 into the collar 33. The length of the packer is known and if necessary an extension string may be included in the retriever to increase the distance between the miller 20 and the catcher 30.

The blades 23 contact the uppermost surface of the packer and begin to mill out the packer. A jet of liquid flowing from ports 22 sweeps swarf and debris upwards into the debris collectors 4 or to surface.

Once the milling has proceeded sufficiently to release the packer from the well casing, the remains of the packer, and ancilliary pipework hung below, drop under gravity and are caught by catcher 30, the weight of the remains urging the catcher 30 against the shear collar 33 and splaying the fingers of the catcher 30 outwards into tight gripping engagement with the packer remains. The packer is then withdrawn from the well. As withdrawal proceeds it is possible for the packer remains to tilt and jam against the well casing or for pieces of debris to become trapped between the packer and the casing causing the packer to jam. This, of course, puts considerable strain on the string and can indeed result in breakage at any point between the retriever and the surface.

The shear collar 33 of this invention is designed to prevent such breakage. The collar 33 is provided with a number of apertures 34 registering with apertures in the central tube. Before sending the retriever down-hole a number of shear bolts are screwed into these apertures to secure the collar. The number of the bolts and the shear strength of the material of which they are made determine the stress at which the bolts shear releasing the collar.

Figure 9A:
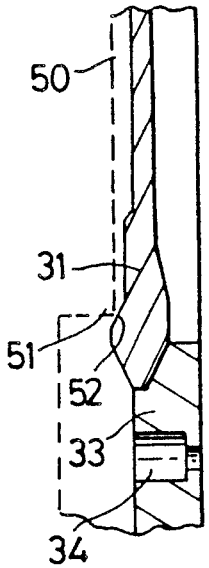
FIGS. 9A and 9B are enlargements of the area encircled in FIG. 5.
Figure 7:
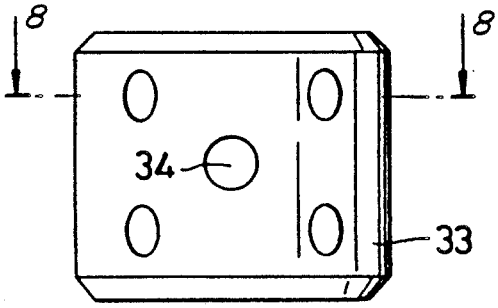
FIG. 7 is a drawing of the shear sleeve indicated by 33 in FIG. 5.
Figure 9B:
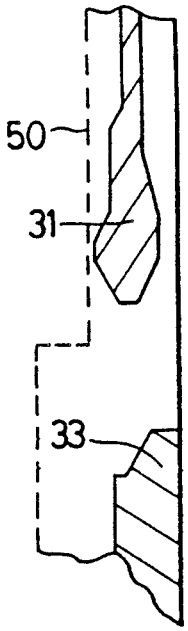
Figure 8:
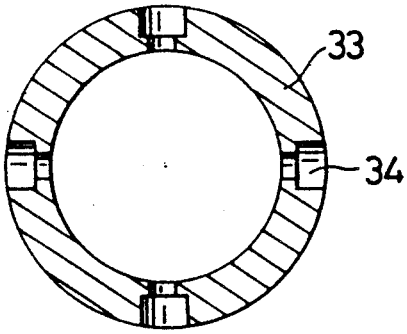
FIG. 8 is a section taken on line F—F in FIG. 7.

The interaction between the packer catcher 31 and the shear collar 33 is illustrated in greater detail in FIG. 9A and B. FIG. 9A shows a packer 50 (indicated by broken lines) held by the catcher 31 and bearing on the shear collar 33. FIG. 9B shows the relative position of these parts after release of the shear collar 33. A packer 51 is held by catcher 31 by means of a shoulder 51 on the mill-out extension, the shoulder bearing on sloping surface 52 of the catcher 31. If the stress preset by selection of the shear bolts located in apertures 34 is exceeded the bolts shear releasing the collar 33 which falls out of engagement with the catcher 31, the weight of the packer then compresses the sprung fingers of the catcher releasing the grip on the packer and allowing the retriever to be withdrawn from the well. After resetting the shear bolts the retriever may again be sent down-hole and the retrieval operation begun afresh.

The shear bolts may be screw-threaded bolts the shear strength of which is known or alternatively simple cylindrical pins may be used which are held in place by a separate screw-threaded plug.

I claim:

1. In an oil well packer retriever comprising a packer miller for milling the packer to release it from the well casing, and a packer catcher mounted on a tubular member extending from the miller for engaging the packer once the packer is released; the packer catcher comprising a sleeve slidable along said tubular member and slotted to define resilient fingers, and including an emergency release means;

the improvement comprising the packer miller including a plurality of radial blades having end faces and side faces provided with abrasive material, the end faces being dimensioned to mill substantially the entire annular surface of the packer, and the side faces having said abrasive material extending along a major portion thereof; and the catcher sleeve being urged by resilient means into engagement with a collar and said emergency release means comprises the collar being secured to the tubular member by shear pins or bolts adapted to shear at a predetermined stress.

2. The packer retriever of claim 1, in which the surface of the shear collar on which said fingers bear is formed as a cam surface arranged to spread said fingers as upward load is applied to the retriever.

3. The packer retriever of claim 1, in which said blades are further provided with non-abrasive radial extensions.

4. The packer retriever of claim 1, including means for delivering a jet of liquid proximate the blades.

5. The packer retriever of claim 1, including a milling head on the end of said tubular member dimensioned to penetrate the bore of the packer.

6. The packer retriever of the claim 5, including means for delivering a jet of liquid proximate the milling head.

7. An oil well packer retriever for removing an annular packer from a well casing, comprising;

a packer milling for milling the packer to release it from engagement in the casing, the packer miller including a plurality of radial blades having end faces and side faces provided with abrasive material, the end faces being dimensioned to mill substantially the entire annular surface of the packer, and the side faces having said abrasive material extending along a major portion thereof, a packer catcher mounted on a tubular member extending from the miller for engaging the packer once the packer is released, the packer catcher comprising a sleeve slidable along said tubular member, the sleeve being slotted to define resilient fingers, a collar secured to the tubular member by shear elements adapted to shear at a predetermined stress, and resilient means urging the sleeve into engagement with said collar, and a milling head on the distal end of said tubular member said milling head being dimensioned to penetrate the bore of the packer and having, in plan view, curved faces matching the bore of the packer and of the packer and joined by flat faces to define spaces between the milling head and the packer bore.

* * * * *